US011191371B2

(12) United States Patent
Rau

(10) Patent No.: US 11,191,371 B2
(45) Date of Patent: Dec. 7, 2021

(54) PRESENTATION DEVICE, IN PARTICULAR FOR GOODS

(71) Applicant: GESA Form + Funktion Displaybau GmbH, Dreieich-Offenthal (DE)

(72) Inventor: Otmar Rau, Dreieich (DE)

(73) Assignee: GESA Form + Funktion Displaybau GmbH

( * ) Notice: Subject to any disclaimer, the term of this patent is extended or adjusted under 35 U.S.C. 154(b) by 173 days.

(21) Appl. No.: 15/718,019

(22) Filed: Sep. 28, 2017

(65) Prior Publication Data

US 2018/0092469 A1 Apr. 5, 2018

(30) Foreign Application Priority Data

Sep. 30, 2016 (DE) ..... 102016118623.6

(51) Int. Cl.

| | |
|---|---|
| ***A47F 11/00*** | (2006.01) |
| ***A47F 5/00*** | (2006.01) |
| ***A47F 11/10*** | (2006.01) |
| ***A47F 5/16*** | (2006.01) |
| ***A47F 5/08*** | (2006.01) |

(52) U.S. Cl.

CPC ..... *A47F 5/0025* (2013.01); *A47F 5/0062* (2013.01); *A47F 5/083* (2013.01); *A47F 5/16* (2013.01); *A47F 11/10* (2013.01); *A47B 2220/0077* (2013.01)

(58) Field of Classification Search

CPC ..... A47F 5/0018; A47F 5/103; A47F 1/12; A47F 1/126; A47F 5/0043; A47F 5/005; A47B 96/06

See application file for complete search history.

(56) References Cited

U.S. PATENT DOCUMENTS

| | | | | |
|---|---|---|---|---|
| 6,193,085 | B1 * | 2/2001 | Nook | A47F 1/126 211/187 |
| 9,357,858 | B2 * | 6/2016 | Sun | A47F 5/0018 |
| 9,629,481 | B2 * | 4/2017 | Karan | F21V 19/003 |

(Continued)

FOREIGN PATENT DOCUMENTS

| | | | |
|---|---|---|---|
| DE | 102016102762 | B4 | 12/2017 |
| EP | 3045088 | A1 | 7/2016 |
| FR | 2926966 | B1 | 3/2010 |

*Primary Examiner* — William J Carter
*Assistant Examiner* — Omar Rojas Cadima
(74) *Attorney, Agent, or Firm* — Gerald E. Hespos; Michael J. Porco; Matthew T. Hespos

(57) ABSTRACT

A presentation device is revealed, in particular for goods, comprising a mounting frame (10) having a plurality of mounting profiles (12, 13; 14) arranged parallel and spaced apart from each other; and a plurality of frame or box-shaped inserts (30) releasably attached to the mounting profiles; the inserts (30) each having a plurality of side walls (31) forming a rectangular frame, and the inserts in each case being detached over their backsides. At the same time, it is preferable to supply the inserts with an electrical voltage at the same time.

The inserts can be considered as modules which are individually attached to the mounting frame and can be designed differently. The inserts are detachably attached to the mounting profiles via their backsides. This means that the presentation equipment can be configured in a simple way for both retrofitting and new installations in salesrooms.

12 Claims, 7 Drawing Sheets

(56) References Cited

U.S. PATENT DOCUMENTS

| | | | | |
|---|---|---|---|---|
| 2006/0261023 | A1* | 11/2006 | Goth | A47F 7/145<br>211/128.1 |
| 2014/0250749 | A1* | 9/2014 | Theisen | F21V 33/00<br>40/649 |
| 2017/0224135 | A1* | 8/2017 | Burns | F21V 23/06 |

* cited by examiner

PRESENTATION DEVICE, IN PARTICULAR FOR GOODS

FILED OF THE INVENTION

The invention generally relates to the presentation of goods, such as cosmetic articles or text and/or graphic information for advertising purposes in connection with any goods/services, and relates in particular to a presentation device with a plurality of presentation modules, which is to be variably configurable in a simple manner both for conversions/retrofits and for new installations in salesrooms.

STATE OF THE ART

Presentation devices of the aforementioned type for goods are installed as part of sales counters, also known as displays, in salesrooms such as supermarkets or drugstores, and offer the customer the possibility of purchasing a particular product, e.g. a cosmetic product. The finished system as part of a display can be found in a drugstore, department store, perfumery, etc. and presents goods (e.g. cosmetic articles) for sale to the end user. The final product is available in different optics depending on customer requirements.

Suppliers of cosmetic products often have their own displays in salesrooms where they display their products in a uniform form. As part of the displays, presentation systems with modules are required to receive and present the goods.

Up to now, substructures for presentation systems have been manufactured individually and usually not flexibly to customer requirements, made of metal, wood and plastic. Modifications of existing constructions were usually not possible or very cumbersome.

Particularly for the presentation of goods, attractively designed modules are sought, which can be produced cost-effectively and flexibly and which are also sufficiently robust.

WO 2006067396 A1 and DE 202014103767 U1 reveal a presentation device with a plurality of shelves arranged one above the other. The shelves are equipped with lighting equipment for the advertising presentation of goods. The electrical supply of these lighting equipment is provided by fixing the shelves to a wall panel or support column.

DE 202012009052 U1 reveals a presentation device with a plurality of panels, the front side of which displays goods to be presented. The panels are detachably attached to another panel or wall by means of a fixing frame or fastening elements.

For the orderly presentation of goods, mostly variable subdivisions in the form of intersecting bars are used, which are arranged on the upper side of shelves or the like, as disclosed in EP 0773727 B1, for example.

For a more effective and attractive presentation of goods, especially in the field of cosmetic articles, presentation devices have proven themselves, which are equipped with shelves made of a transparent material, such as transparent plastic, which enable a background lighting function for the goods to be presented. The shelves act as light guides from which the light is decoupled in a suitable way to illuminate the goods. Such presentation device are, for example, disclosed in the German utility model 202013104137 of the applicant. The EP3045088 also reveals a ladder system in which vertical mounting profiles and horizontal mounting profiles are combined to accommodate presentation boxes in the bays. The content of EP 3045088 is included in this document for a better understanding of the application.

OVERVIEW OF THE INVENTION

The purpose of the present invention is to provide an improved frame or ladder construction for presentation device comprising a plurality of presentation modules, which are electrified or non-electrified, so that the presentation device is to be easily and variably configurable for both conversions and new installations in salesrooms.

This task is solved by a presentation device according to claim 1. Further advantageous forms of embodiments are subject to the depending subclaims.

A presentation device according to the present invention is used for the presentation of goods and/or text and/or graphic information. This comprises a mounting frame with a plurality of mounting profiles arranged parallel and spaced apart from each other. The mounting profiles are designed as endless profiles with suitable lengths, arranged at regular intervals and parallel to each other. In particular, the mounting profiles can be arranged crosswise horizontally and vertically to form a plurality of mounting bays whose sizes are suitably the identical, but can also deviate from each other by a multiple number in one or two dimensions; alternatively, other mounting profiles can also be arranged horizontally and vertically, deviations from this pattern are possible. A number of frame or box-shaped inserts are detachably attached to the mounting profiles, each of which serves to present goods and/or text and/or graphic information. The inserts each have a plurality of side walls, providing a very stable and load-bearing rectangular frame.

In accordance with the invention, the horizontal mounting profiles have at least one supporting surface on which the insert rests, and wherein recesses are formed in the horizontal mounting profiles, into which projections of the inserts can be inserted in order to align the insert. The recesses are preferably formed in the supporting surface, and projections of the inserts formed on the underside of the inserts extend into the recesses. It is also conceivable that the recesses may extend around an edge of the supporting surface. This allows the box to be inserted from the side and from above with the protrusions (which are not shown) into the recess. The boxes can thus be positioned exactly on the flat supporting surfaces that are formed on the horizontal mounting profiles. The support area is preferably T-shaped, with a centre bar. To the right and left of the centre bar, the edges or the underside of two inserts can be placed on.

The centre bar thus prevents the inserts from slipping together. The inserts are thus arranged at a distance from each other. This approach enables individual inserts to be replaced at any time.

In a preferred embodiment, at least two recesses are arranged on the horizontal mounting profile, spaced so that two half inserts can be inserted and locked into a conductor field. It is also conceivable that there are considerably more recesses and thus a multiple of inserts can be arranged. Please note that the recesses must be spaced out at regular intervals. Pairs of recesses are also conceivable, so that half a box has to snap into at least 2 recesses at the top and 2 at the bottom.

Alternatively or cumulatively to the recesses, at least one locking device is arranged in the horizontal mounting profiles in the form of a projection or recess, which serves to fix the insert. After the insert has been aligned through the recesses, it can be locked by pressing it into place. Either a projection of the insert reaches into a further recess or a projection of the horizontal mounting profile reaches into a side wall or into the base of an insert. This ensures that the insert is fixed after it has been aligned and can only be loosened with additional effort. In a preferred embodiment, the locking devices are designed as recesses in the centre bar. The corresponding noses, which are formed in the side wall of the insert, can extend into the recess. Depending on the shape of the nose, the unlocking can be difficult.

Alternatively or cumulatively to the above-mentioned embodiments, the invention provides contact rails that extend along the entire length of the horizontal mounting profiles to establish contact with the insert on the one hand, and contact with one of the vertical mounting profiles on the other. The vertical mounting profile is preferably made of metal or has a metallic conductor to provide a voltage. The horizontal mounting profile is preferably made of non-conductive plastic material. It can also be made of metal and may have a suitable insulator. The centre bar separates two power contact rails from each other so that a horizontal mounting profile can provide both the positive and negative pole separately from the centre bar.

In a possible embodiment, the power contact rails are each connected to a different opposite vertical mounting profile via a contact lug to provide the positive and negative terminal. Thus, one power contact rail is connected to the right vertical mounting profile and the other power contact rail is connected to the left vertical mounting profile. This allows sufficient electrical energy to be supplied with low voltage to power the inserts and their lighting.

In a possible embodiment, the power contact rails are flat sheets which are clamped by clamps formed on the horizontal mounting profiles. The terminals grip the power contact rails from the side and clamp the power contact rail against the centre bar. In this case, a groove could be formed in the centre bar to prevent the power contact rail from slipping. An electrical contact pin of the insert could then be pressed onto the contact rail with spring force and could thus establish an electrical contact. This contact pin is preferably formed on the upper and lower part of the underside, so that the insert can be contacted with two horizontal mounting profiles.

As an alternative or cumulatively to the above-mentioned embodiments, the vertical mounting profile has projections with fastening means sectionwise, preferably for clamping the horizontal mounting profile, so that they are arranged in an elevated position in the vertical mounting profile. The raised arrangement allows a deeper design of the inserts whereby the horizontal mounting profile is shifted less visibly downwards. The inserts are thus placed in direction towards of the viewer.

Preferably, the fastening means of the projections consist of one or more recesses that engage in the hooks of the horizontal mounting profile. Furthermore, the fastener on the upper side of the projection includes a support area on which the horizontal mounting profile or a projection of the horizontal mounting profile rests, so that a clamping fixture is formed, whereby the hooks clamp the projection of the horizontal mounting profile onto the support area.

The support area is to be seen as a flat part of the projection, and the hooks that reach into the recesses create a pull that pushes the projection of the horizontal mounting profile onto the straight projection of the vertical mounting profile.

In a preferred embodiment, a groove is formed in the projection of the horizontal mounting profile into which the projection of the vertical mounting profile can be inserted to prevent slipping.

According to the invention, the inserts can be regarded as modules that are individually attached to the mounting frame and can be designed differently. The inserts are detachably attached to the mounting profiles via their backsides. This means that the device can be configured in a simple way for both retrofitting and new installations in salesrooms.

In practical terms, all inserts have the same basic dimensions, or are modularly subdivided into sizes so that they correspond to a multiple or an integer fraction of the module size, so that the modules can be easily stored, stacked and transported, for example, and can easily be exchanged for each other, for example with a different functionality.

According to a preferred embodiment, the inserts are directly connected to the mounting profiles via the rear sides of the side walls of the inserts, with the base surfaces of the modules corresponding to the base surfaces of the mounting frame, or an integer multiple or a fraction thereof. Thus, the inserts do not protrude, or only insignificantly, beyond the fields of the mounting frame defined by the mounting profiles. The arrangement of the mounting profiles makes it easy to determine the subsequent arrangement of the inserts, for example in a matrix arrangement in rows and columns, whereby the inserts themselves can always be fastened to the mounting profiles in the same way by simple connections, which helps to reduce the overall time required for an assembly.

The detachable attachment of the inserts to the mounting profiles is designed in such a way that the inserts are supplied with a supply voltage, e.g. with a low-voltage direct voltage, via the conductor tracks when the inserts are detachably attached to the mounting profiles. In other words: when the inserts are attached to the mounting profiles, the electrical supply of the inserts is automatically provided via the conductor tracks, so that costly additional steps for electrifying the inserts can be eliminated. The supply voltage can be used in particular to operate lighting equipment such as LED strips or illuminants, and/or electrical equipment such as displays, music players and the like provided in the inserts. For this purpose, electrical cables or conductor tracks as well as connection devices such as plugs or connection bases can also be provided in the inserts, for example in the side walls of the inserts.

In accordance with another embodiment, contact pins are provided on the backside of the inserts, which are automatically pressed against the tracks when the inserts are detachably attached to the mounting profiles. For this purpose, in a relaxed normal state, the contact pins can protrude slightly beyond the plane extending from the back or the frame of the inserts and, in an assembly state, they can be pressed against the assigned tracks by means of a resetting element, such as a spring or a metal strip.

According to another embodiment, at least some of the inserts have back walls, so that they can prevent the falling out of goods to be presented and the inserts are designed for storing and/or holding goods to be presented. Insertion shelves can be inserted into the side walls or retaining lugs provided there as required.

According to another embodiment, the rear wall comprises an optical conduction plate, which can also be designed directly from the respective rear wall, whereby light from an LED strip is coupled into the optical conduction plate for backlighting. The backlighting makes it possible to present the goods stored or held in the presentation module (insert) in an even more effective way. Or the backlighting can be used to illuminate text and/or graphic information in an effective way. In particular, the front sides of at least some of the inserts may be covered by a transparent or opaque cover, in particular a transparent or opaque plastic sheet, the cover being designed to provide text and/or graphic information.

In another version, the mounting frame is arranged on a ramp-shaped body, so that the mounting frame is mounted in an inclined position. This allows the products placed further in the background to be lifted up for the viewer to see them more clearly.

In a preferred embodiment the assembly frame is designed in the form of a ladder with horizontal and vertical mounting profiles, whereby the box-shaped inserts are arranged in the ladder sections.

In this case, the horizontal and vertical mounting profiles are preferably clamped together, whereby the horizontal mounting profile is preferably made of plastic and stretches around the vertical mounting profile in areas of clamping.

A presentation device, as shown here, can be mounted on a mounting frame in a presentation furniture or attached to a wall panel.

This approach allows for plug-and-play of modules and display systems, enabling efficient setup and adaptation.

DESCRIPTION OF THE FIGURES

In the following, the invention will be described in an exemplary manner with reference to the enclosed drawings, which will result in further characteristics, advantages and tasks to be solved. It shows.

In the figures, identical reference signs denote identical elements or groups of elements.

DETAILED DESCRIPTION OF EMBODIMENTS

Figure 1:
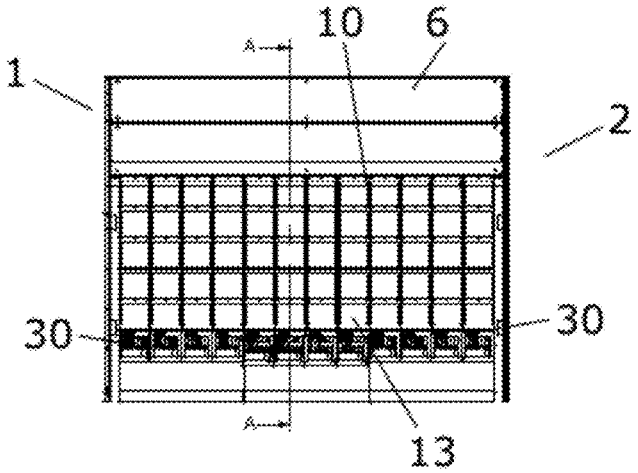
FIG. 1 a frontal view of a presentation device for goods according to the present invention.

The FIG. 1 shows a presentation device 1 for goods according to this invention. This comprises a plurality of box-shaped inserts 30 with a rectangular base area, which are arranged in a matrix arrangement and are integrated in the matrix structure shown in the FIG. 2, comprising a horizontally extending corpus 4 with several drawers, vertical side walls 5 and an upper advertising surface 6 for presenting text and/or graphic information.

Figure 3:
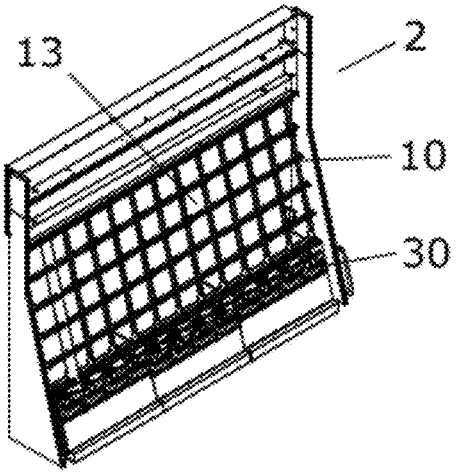
FIG. 3 a presentation device according to FIG. 1 in perspective view.
Figure 4A:
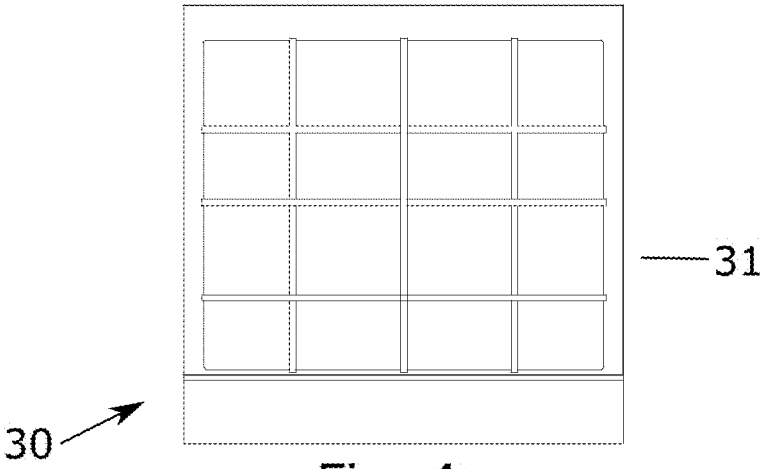
FIG. 4*a-c* is an example of a box-shaped insert, from the front, from the side and in a perspective view.
Figure 4B:
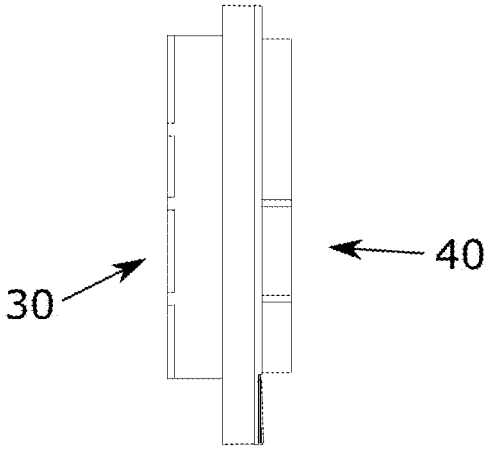
Figure 4C:
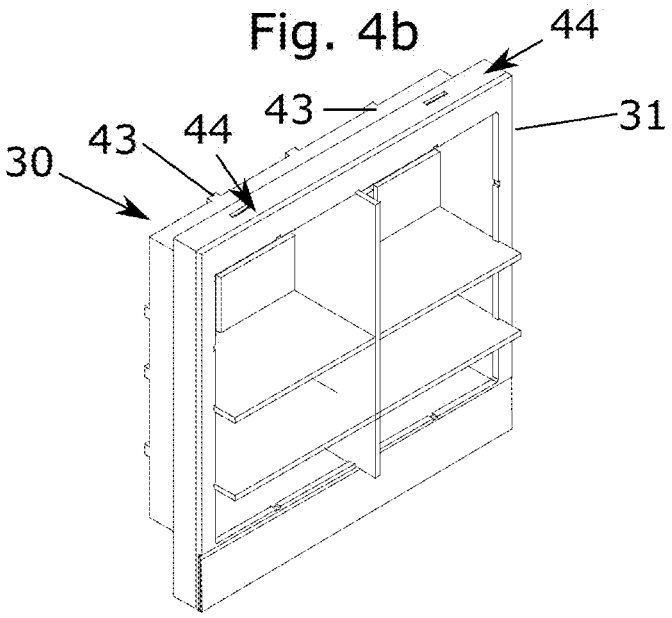

The FIGS. 1 and 3 show the arrangement of the mounting frame 10 within the presentation furniture 2. Mounting frame 10 is formed by a plurality of horizontal mounting profiles 12 and vertical mounting profiles 11 extending vertically to it, which are connected with each other by means of a clamp connection, as described below on the basis of the figures. Mounting frame 10 is divided by mounting profiles 11, 12 into a plurality of sections 13 of the same size, whose height/width is preferably an integer multiple of the height/width of inserts 30 to be attached to mounting frame 10. Of course, the mounting profiles 11,12 can also define different subdivisions of the mounting frame 10 for each section.

Figure 2A:
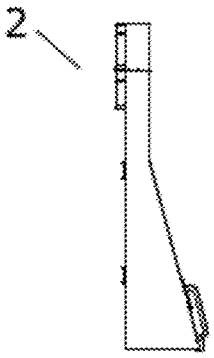
FIG. 2*a* a presentation device according to FIG. 1, from the side.
Figure 2B:
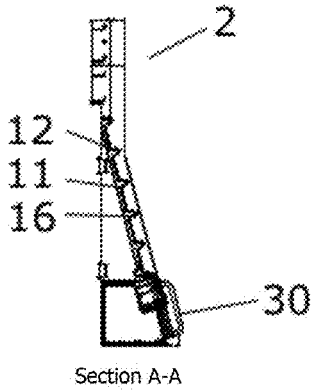
FIG. 2*b* a presentation device according to FIG. 1 in a sectional view.

According to FIG. 2 only the upper section of the mounting frame 10 extends parallel to the rear wall 3 of the presentation furniture 2. The middle and lower sections of the mounting frame 10 extend at an acute angle to the plane of the upper section of the mounting frame 10.

The FIG. 3 shows the mounting frame of the presentation device according to FIG. 1 in a perspective side view. Not all inserts 30 are yet attached to the mounting frame. The inserts marked with the reference sign 30 are arranged in a row in the lower area. According to FIG. 4*a-c* and 5, the inserts 30 are box-shaped, with a rear wall 32 and four side walls 31. On the inner sides of the vertical side walls 31, several retaining projections 33 are provided in a grid arrangement into which at least one shelf 34 can be inserted to support the goods to be presented.

Further inserts can also be designed as a frame, i.e. without a rear wall, which allows a clear view of the rear wall 3 of the presentation furniture 2 (see FIG. 1), a wall or an advertisement.

FIGS. 4*a-c* and FIG. 5 show an insert 30. When the insert 30 latching hooks 43 are inserted into the recesses 60*a*, 60*c* of the horizontal profile, the electrical contact pins 36 of insert 30 is pressed against the respective contact rails 63*a, b*, whereby an electrical energy supply of a backlight is provided, which is realized by coupling the light of an LED strip having a plurality of LEDs into the front side of the light conducting plate 35. The light conducting plate 35 can also form the rear wall of the insert 30. The backlighting can be used to illuminate articles placed on the side wall 31 of the insert or on shelves or similar objects in a way that is effective for advertising purposes, or to backlight text and/or graphic information. For this purpose, the front of the insert 30 can also be covered by a transparent or opaque cover 40, on which the text and/or graphic information to be displayed is provided in the familiar manner as shown in FIG. 5*b*. This text and/or graphic information can also be inserted into a cover 40 socket.

In addition, the protruding fixations 44 can be clamped into the lockings 61*a* and 61*b*. This prevents the insert from being easily removed.

It is also conceivable that the inserts can be used as monitors or touch screen. Monitors in formats 20×20/20×40 or 40×40 mm/cm or digital textstripes can also be used where today's paper ticketstrips are common. This enables an optimal communication management at the push of a button from the office computer.

The above-mentioned electrical supply of the insert can also be used for the electrical supply of any other light source or lighting equipment or of electrical devices which are included in or attached to the insert, such as displays or music players.

As the expert will easily be able to see when studying the above description, the presentation system can be provided cost-effectively and attractively and can be adapted to individual customer requirements in a very variable manner. The electrification of the presentation modules (inserts) makes it possible to present goods or text and/or graphic information in a very effective way. The presentation system presented here is particularly suitable for the presentation of cosmetic articles with plastic inserts and the use of lighting effects, especially backlighting, in at least some of the presentation modules (inserts). The presentation system according to the present invention can also be used in a corresponding manner to present any other products, such as consumer or electronic items.

Figure 5:
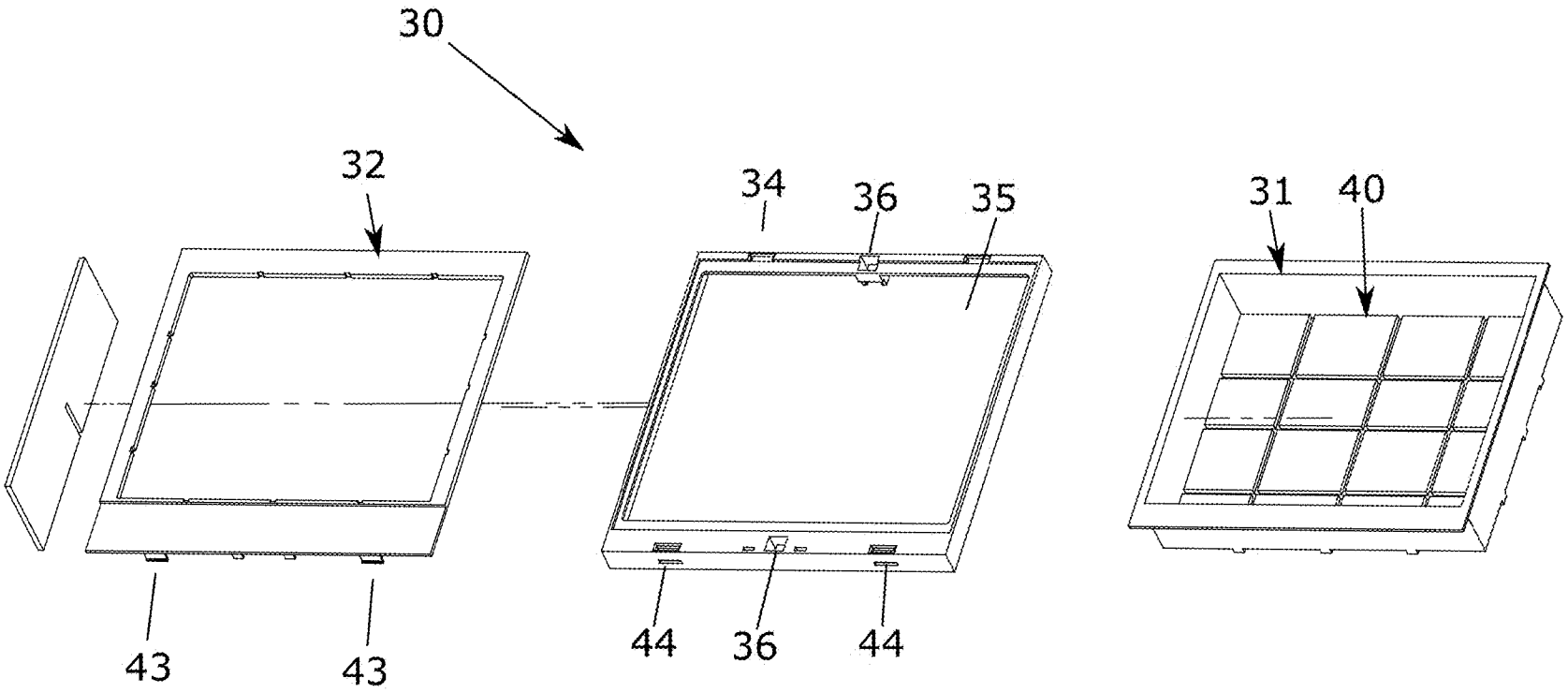
FIG. 5 a box-shaped insert in an exploded view.

The FIG. 5 shows a box-shaped insert with hole-shaped holders for lipsticks in which the lipsticks are arranged. Such a box-shaped insert can be mounted on a mounting frame with a conductor structure.

Figure 6C:
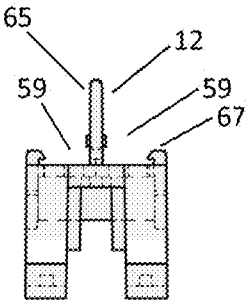
FIG. 6*a*-6*c* views of a horizontal mounting profile.
Figure 6A:
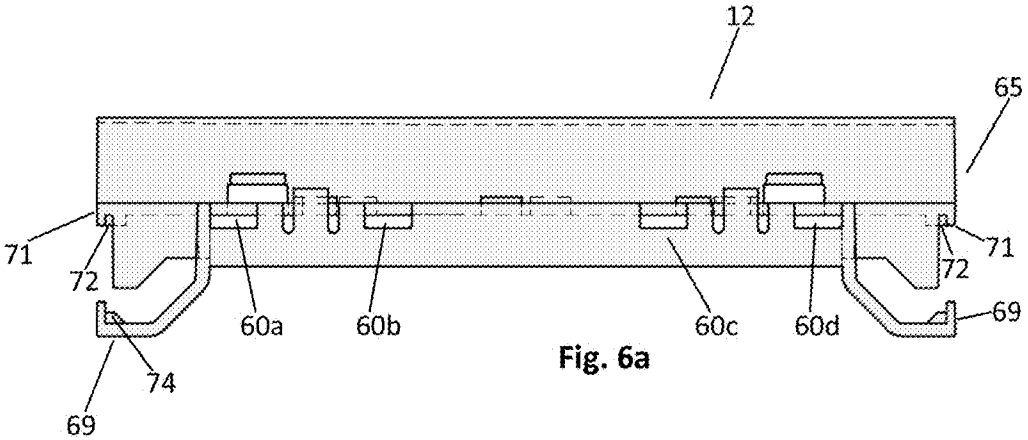
Figure 6B:
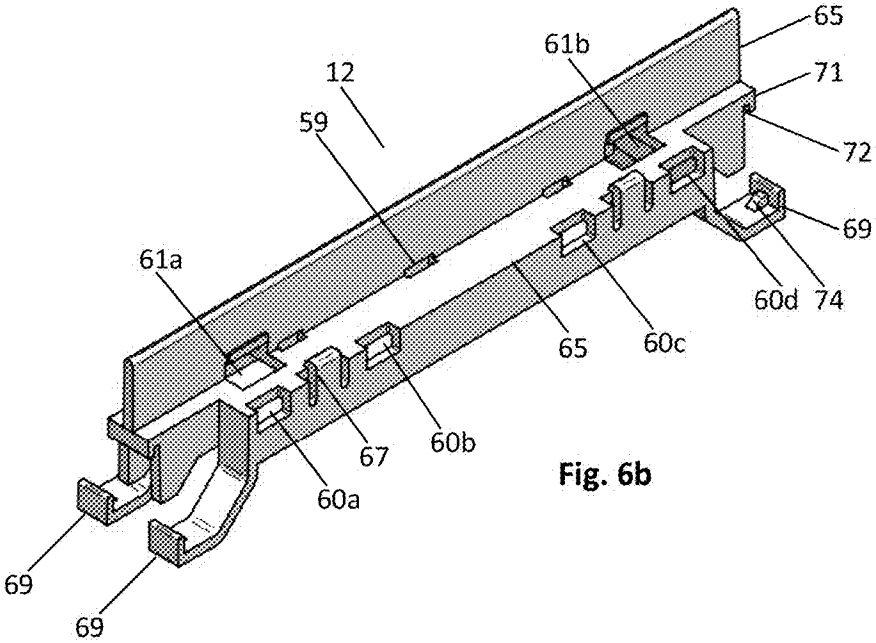

The FIG. 6*a* to 6*c* show the horizontal mounting profile from different perspectives. FIG. 6*a* shows the horizontal mounting profile from a side view. FIG. 6*b* shows a perspective plan view. FIG. 6*c* shows another side view of the front face.

The horizontal mounting profile has 2 contact surfaces 59 on which the underside of two adjacent inserts rests. In addition, the two contact surfaces are separated from each other by a centre bar 65. This centre bar is intended to ensure a small spatial distance between the inserts so that they are electrically and spatially separated from each other in order to be mounted better. On the supporting surface 59 a row of recesses 60*a*-60*d* are arranged, each in 2 pairs. Each pair is arranged in the middle of the table with respect to half of the contact surface. This means that half inserts can also be aligned. Of course, other arrangements are also possible. The locking hooks 43 of the inserts preferably engage in the recesses 60*a*-60*d*. Depending on the type of application, closely spaced recesses are used, such as 60*a* and 60*d* for a half size insert, or recesses further spaced out like 60*a* and 60*d* for a full size insert. In addition, the centre bar also includes locking devices 61*a* and 61*b*, which can intervene in the fixing points 44 of the insert. This prevents the box from being easily removed. Furthermore, the horizontal mounting profile includes hooks 69 at its left and right outer ends, which are placed in recesses 69 (see FIG. 8 and FIG. 9) of the vertical mounting profile. These hooks are designed to be flexible so that they can build up a tension. The counterpart of the holder is a projection 71, which has a groove 72. The projection 71 is used to be placed on a support area 70 of the vertical mounting profiles. This support area is preferably a thin sheet metal that is designed to be inserted into the groove 72. Using hooks 69 with a small ramp 74, it is possible to build up a tension which ensures a clamping attachment to the vertical mounting profile.

Figure 7C:
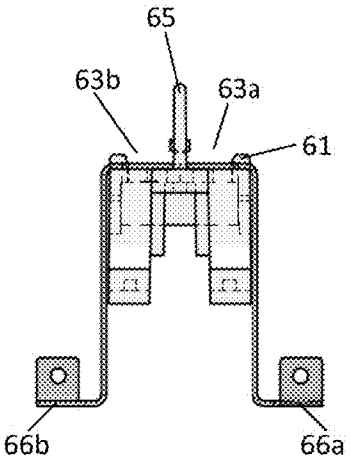
FIG. 7*a*-7*c* views of a horizontal mounting profile with contact rails.
Figure 7A:
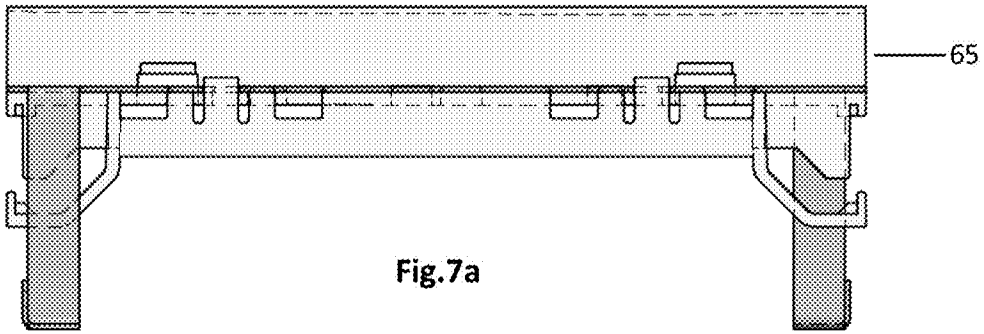
Figure 7B:
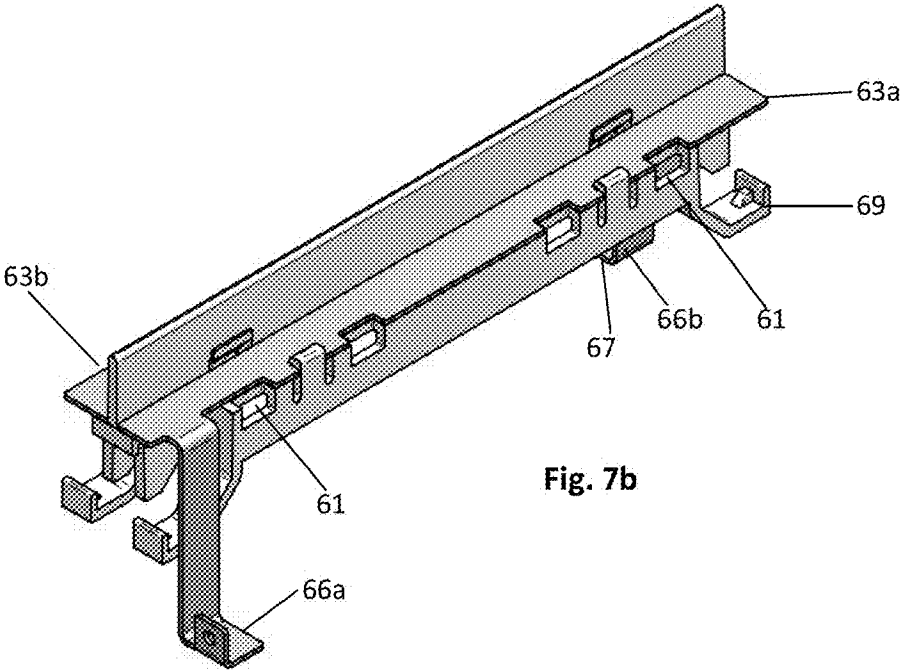

The FIG. 7A to 7C also show the horizontal mounting profile according to FIG. 6. However, additional contact rails 63*a*, 63*b* are arranged on the contact surfaces 59. These preferably extend over the entire length of the bearing surface. However, it is also conceivable that these will be kept shorter. As a rule, the contact rails are made of a conductive sheet metal. The horizontal mounting profile is preferably made of plastic or a non-conductive material in this area. For example, it is conceivable that insulation between the contact surface and the horizontal mounting profile may be arranged if the horizontal mounting profile is made of metal. The contact rail has a contact lug 66*a* or 66*b* at its ends. The contact lug is extended downwards to be brought into contact with the vertical mounting profile. The vertical mounting profile is either made entirely of metal or has a track in this area. This makes it possible, for example, to make contact with a screw that is passed through a hole in the contact lug. A corresponding hole can then also be found in the vertical mounting profile. In an alternative embodiment, the contact lug is pressed against the vertical mounting profile by means of a mechanical tension, thus creating the necessary contact. The contact lugs 66*a* and 66*b* are arranged on the opposite sides of the horizontal mounting profile. This means that a positive and negative voltage can be provided on a horizontal mounting profile. The contact rails are preferably held in place by means of locking device 61, which is designed on the contact surface 59. The contact rails also have recesses for recesses 60*a, b, c, d.*

Figure 8:
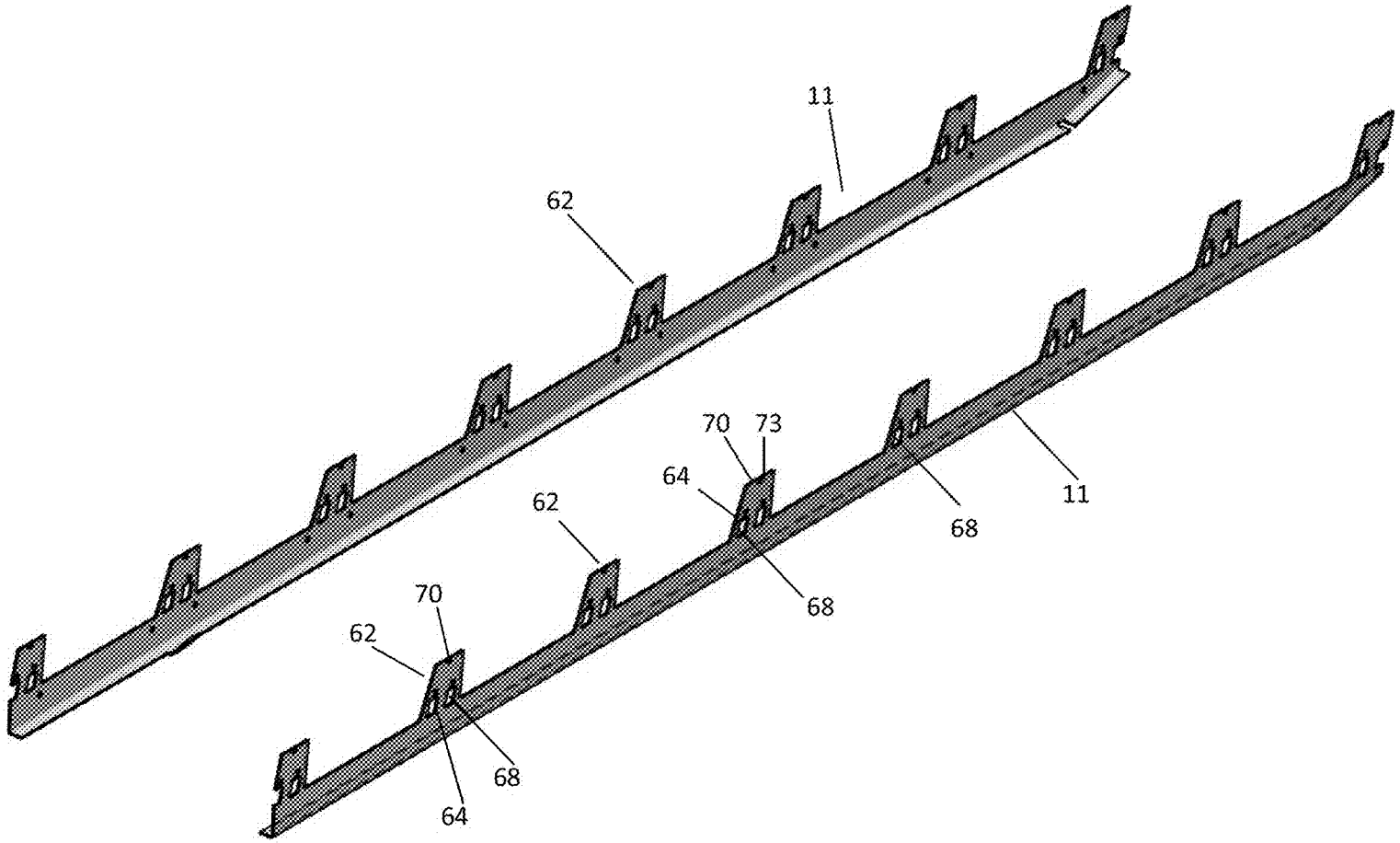
FIG. 8 a view of vertical mounting profiles.

The FIG. 8 shows two vertical mounting profiles, each with projections 62 at regular intervals. At the projections, fasteners 64 are formed, which consist of recesses 68 and a support area 70. In the figures, two recesses 68 per projection 62 are formed in each of the figures, into which the hooks 69 of the horizontal mounting profile extend. The projection 71 of the horizontal mounting profile lies on the edge 73 of the support area 70. Thus, a downward pull through the hooks 69 can be achieved. The fact that groove 72 can extend around edge 73 strengthens the fastening and prevents slipping out. The vertical mounting profile preferably has an L-shaped cross-section and is made of sheet metal. The projections 62 are preferably punched out of the sheet metal. Further holes can be drilled in the sheet metal to establish connections with the contact lugs 66*a*, 66*b*. The protrusion of the plate allows the vertical mounting profiles to be placed higher up, allowing the inserts to reach a greater structural depth. However, it is also conceivable that the horizontal mounting profiles can alternatively extend downwards in a U-shaped manner at their outer areas to create this difference in height. In this case the sheet metal would be straight. This is, in the end, an equivalent embodiment.

Figure 9:
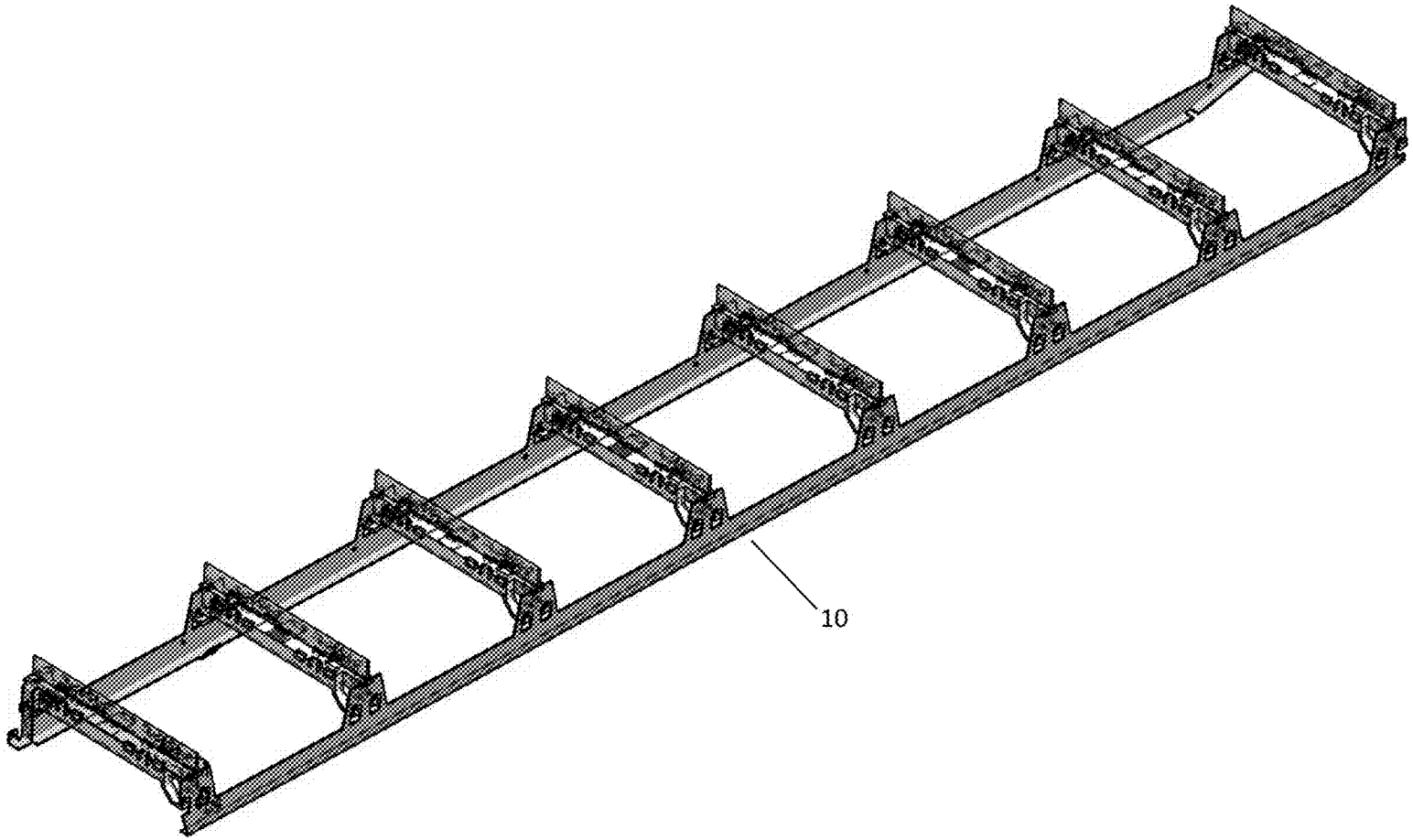
FIG. 9 a view of connected vertical and horizontal mounting profiles.

The FIG. 9 shows the components of the FIG. 8 and FIG. 7 in assembled condition. It can be clearly seen that the hooks extend into the recesses in the projections and that a ladder-shaped system is created. By stringing several of these conductors together, a system as shown in the FIGS. 1 and 2 was displayed.

The FIG. 8 shows a ladder-shaped mounting frame 10 with vertical mounting profiles 11 and horizontal mounting profiles 12. The horizontal mounting profiles are preferably made of plastic and have clamping ranges 55, which are clamped around the vertical mounting profile and thus lock it in place. For this purpose, two clamping elements reach into the vertical profile from below and let it snap into place behind the corresponding noses.

A current conduction can be formed in vertical mounting profiles, since these are connected by vertical mounting profiles made of plastic, different polarities can be given. The box-shaped inserts may have pins that contact the metal vertical profiles via the contact rails to receive voltage so that the LEDs in the box-shaped inserts are supplied with voltage.

REFERENCE CHARACTER LIST

1 product presentation system
2 presentation furniture
3 Rear panel
4 Body
5 Side wall
6 upper advertising space
10 Mounting frame
11 Vertical mounting profile
12 Horizontal mounting profile
13 Field
30 Insert
31 Side panel
32 Rear panel
33 Holding lead
34 Shelf
35 Light conducting plate
36 Electrical contact pin

40 Front cover
43 Locking hooks
44 Fixation
59 Supporting surface
60*a*, 60*b*, 60*c*, 60*d* Recess for alignment of inserts
61*a*, 61*b* Locking device
62 projection in vertical mounting profile
63*a*, 63*b* Contact rails
64 Fixing means in the vertical mounting profile
65 Centre bar
66*a*, 66*b* Contact lug
67 Terminal for contact rail
68 Recess in the lead
69 Hook
70 Support area
71 Advantage
72 Groove
73 Edge of bearing surface
74 Ramp

The invention claimed is:

1. A presentation device, in particular for goods, comprising:

a mounting profile, comprising:

a plurality of vertical mounting profiles spaced from and substantially parallel to each other, each of the plurality of vertical mounting profiles having a plurality of supports spaced apart along a length of each of the plurality of vertical mounting profiles, each of the plurality of supports having at least one recess;

a plurality of horizontal mounting profiles, each of the plurality of horizontal mounting profiles having a support surface with a center bar projecting therefrom and extending between the first and second ends to define first and second contact surfaces on the supporting surface on opposite sides of the center bar, and at least one engaging member formed as an opening on at least one of the first and second contact surfaces and the center bar, wherein each of the plurality of horizontal mounting profiles is arranged so that the plurality of vertical mounting profiles and the plurality of horizontal mounting profiles are arranged at substantially right angles to each other, a plurality of sections are defined and bound by pairs of adjacent horizontal mounting profiles of the plurality of horizontal mounting profiles, and one or more pairs of adjacent vertical mounting profiles of the plurality of vertical mounting profiles; and a plurality of box-shaped inserts mounted individually in the plurality of sections, each of the plurality of inserts having a rear wall, and a plurality of side walls projecting from the rear wall to define a rectangular frame, at least one fixing device formed as a protrusion provided on each of the plurality of inserts at a position to engage the at least one engaging member to fix each of the plurality of inserts to the respective horizontal mounting frame.

2. The presentation device according to claim 1, wherein the at least one engaging member comprises at least two recesses (60*a* and 60*c*) arranged on each of the plurality of horizontal mounting profiles, which are spaced in such a way that two half inserts can be used and aligned in a section.

3. The presentation device according to claim 2, wherein the at least two recesses (60*a*-60*c*) on the supporting surface extend around an edge (73) of the supporting surface.

4. The presentation device according to claim 1, wherein two power contact rails (63*a*, 63*b*) are spaced through the centre bar (65), the power contact rails each being connected with a different opposite vertical mounting profile via a contact lug (66*a*, 66*b*), so as to provide current with positive pole and negative pole.

5. The presentation device according to claim 4, wherein the current contact rails are flat sheets which are held in place by clamps (67) formed on the horizontal mounting profiles.

6. The presentation device according to claim 4, whereby the inserts are supplied with low-voltage direct voltage via the vertical mounting profiles, the contact lugs (66*a*, 66*b*) and the power contact rails to supply the lighting devices and/or electrical devices of the inserts with the supply voltage when these are inserted, with contact pins (36) being provided on the rear sides of the inserts (30) which are pressed against the power contact rails when the inserts (30) are connected with the terminals (36).

7. The presentation device according to claim 1, whereby the horizontal and vertical mounting profiles (11, 12) are clamped together.

8. The presentation device according to claim 1, wherein at least some of the plurality of inserts are designed for the storage and/or support of goods to be presented.

9. The presentation device of claim 1, wherein the rear wall comprises an optical conduction plate (35) or being formed by the latter into which light of an LED strip (37) is coupled for background lighting.

10. The presentation device according to claim 1, wherein the fronts of at least some of the inserts (30) are covered by a transparent or opaque cover (40), the cover being adapted to provide text and/or graphic information.

11. The presentation device according to claim 1, wherein the mounting frame (10) is accommodated in a presentation device (2) or is fixed to a wall panel or is fastened to a ramp-shaped body (4) on which the mounting frame is arranged at an angle.

12. The presentation device according to claim 1, wherein the horizontal mounting profile is made of plastic and the vertical mounting profile is made of metal.

* * * * *